US010381740B2

(12) United States Patent
Karlsson et al.

(10) Patent No.: US 10,381,740 B2
(45) Date of Patent: Aug. 13, 2019

(54) ANTENNA FEEDING NETWORK COMPRISING A COAXIAL CONNECTOR

(71) Applicant: CELLMAX TECHNOLOGIES AB, Kista (SE)

(72) Inventors: Dan Karlsson, Sollentuna (SE); Niclas Yman, Ekero (SE); Stefan Jonsson, Sollentuna (SE)

(73) Assignee: Cellmax Technologies AB, Kista (SE)

( * ) Notice: Subject to any disclaimer, the term of this patent is extended or adjusted under 35 U.S.C. 154(b) by 0 days.

(21) Appl. No.: 16/075,659

(22) PCT Filed: Feb. 2, 2017

(86) PCT No.: PCT/SE2017/050087
§ 371 (c)(1),
(2) Date: Aug. 5, 2018

(87) PCT Pub. No.: WO2017/135875
PCT Pub. Date: Aug. 10, 2017

(65) Prior Publication Data

US 2019/0051961 A1 Feb. 14, 2019

(30) Foreign Application Priority Data

Feb. 5, 2016 (SE) ..... 1650146

(51) Int. Cl.
*H01P 5/02* (2006.01)
*H01P 5/12* (2006.01)
(Continued)

(52) U.S. Cl.
CPC ..... *H01Q 21/0006* (2013.01); *H01P 5/026* (2013.01); *H01P 5/12* (2013.01);
(Continued)

(58) Field of Classification Search
CPC .... H01Q 21/0006; H01Q 21/08; H01Q 21/26; H01Q 1/246; H01Q 3/30; H01P 5/04; H01P 5/026; H01P 3/06; H01R 2201/02
See application file for complete search history.

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Robert Karacsony
(74) *Attorney, Agent, or Firm* — The Jansson Firm; Pehr B. Jansson

(57) ABSTRACT

An antenna feeding network for a multi-radiator base station antenna and an antenna arrangement comprising such a feeding network is provided. The feeding network comprises substantially air filled coaxial lines and a coaxial connector for an antenna feeder cable, the connector being connected to at least one of the coaxial lines. The substantially air filled coaxial lines each have a central inner conductor and an elongated outer conductor surrounding the central inner conductor. The coaxial connector comprises a body having an attachment portion, the attachment portion being attached to, and arranged in abutment with, a portion of at least one outer conductor such that the body connects
(Continued)

electrically and mechanically with the outer conductors of the coaxial lines.

19 Claims, 5 Drawing Sheets

(51) Int. Cl.
*H01Q 3/26* (2006.01)
*H01Q 21/00* (2006.01)
*H01R 24/50* (2011.01)

(52) U.S. Cl.
CPC ..... *H01Q 3/26* (2013.01); *H01R 24/50* (2013.01); *H01R 2201/02* (2013.01)

(56) References Cited

U.S. PATENT DOCUMENTS

| | | | |
|---|---|---|---|
| 2001/0048351 | A1 | 12/2001 | Love |
| 2002/0135520 | A1 | 9/2002 | Teillet et al. |
| 2002/0135527 | A1 | 9/2002 | Teillet et al. |
| 2004/0203284 | A1 | 10/2004 | Stolle et al. |
| 2004/0263389 | A1 | 12/2004 | Haunberger et al. |
| 2005/0134517 | A1 | 6/2005 | Gottl |
| 2007/0241984 | A1 | 10/2007 | Schadler |
| 2008/0139044 | A1 | 6/2008 | Hantsch et al. |
| 2010/0001811 | A1 | 1/2010 | Haunberger et al. |
| 2010/0007571 | A1 | 1/2010 | Riedel |
| 2010/0201590 | A1 | 8/2010 | Girard et al. |
| 2010/0283710 | A1 | 11/2010 | Lutman et al. |
| 2013/0088402 | A1 | 4/2013 | Lindmark et al. |
| 2014/0035698 | A1 | 2/2014 | Schadler et al. |
| 2014/0139387 | A1 | 5/2014 | Jones et al. |
| 2015/0109183 | A1 | 4/2015 | Smith |
| 2015/0180135 | A1 | 6/2015 | Jonsson et al. |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och registreringsverket Box 5055 S-102 42 Stockholm, Sweden.

PCT/SE2017/050087, International Search Report, dated May 4, 2017, Patent-och registreringsverket Box 5055 S-10242 Stockholm, Sweden.

PCT/SE2017/050087, Written Opinion of the International Searching Authority, dated May 4, 2017, Patent-och registreringsverket Box 5055 S-10242 Stockholm, Sweden.

PCT/SE2017/050088, International Search Report, dated Apr. 28, 2017, Patent-och registreringsverket Box 5055 S-10242 Stockholm, Sweden.

PCT/SE2017/050088, Written Opinion of the International Searching Authority, dated Apr. 28, 2017, Patent-och registreringsverket Box 5055 S-10242 Stockholm, Sweden.

PCT/SE2017/050618, International Search Report, dated Aug. 30, 2017, Patent-och registreringsverket Box 5055 S-10242 Stockholm, Sweden.

PCT/SE2017/050618, Written Opinion of the International Searching Authority, dated Aug. 30, 2017, Patent-och registreringsverket Box 5055 S-10242 Stockholm, Sweden.

PCT/SE2016/050864, International Search Report, dated Nov. 30, 2016, Patent-och registreringsverket Box 5055 S-10242 Stockholm, Sweden.

PCT/SE2016/050864, Written Opinion of the International Searching Authority, dated Nov. 30, 2016, Patent-och registreringsverket Box 5055 S-10242 Stockholm, Sweden.

PCT/SE2016/050867, International Search Report, dated Dec. 14, 2016, Patent-och registreringsverket Box 5055 S-10242 Stockholm, Sweden.

PCT/SE2016/050867, Written Opinion of the International Searching Authority, dated Dec. 14, 2016, Patent-och registreringsverket Box 5055 S-10242 Stockholm, Sweden.

PCT/SE2016/050868, International Search Report, dated Dec. 16, 2016, Patent-och registreringsverket Box 5055 S-10242 Stockholm, Sweden.

PCT/SE2016/050868, Written Opinion of the International Searching Authority, dated Dec. 16, 2016, Patent-och registreringsverket Box 5055 S-10242 Stockholm, Sweden.

ANTENNA FEEDING NETWORK COMPRISING A COAXIAL CONNECTOR

FIELD OF THE INVENTION

The invention relates to the field of antenna feeding networks for multi-radiator antennas, which feeding network comprises air filled coaxial lines.

BACKGROUND

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of just one junction between 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at the common port, i.e. the input port in case of a splitter and the output port in case of a combiner.

A person skilled in the art would recognize that the feeding network is fully reciprocal in the sense that transmission and reception can be treated in the same way, and, to simplify the description of this invention, only the transmission case is described below.

The antenna feeding network may comprise a plurality of parallel coaxial lines being substantially air filled, each coaxial line comprising a central inner conductor at least partly surrounded by an outer conductor with insulating air in between. The coaxial lines and the reflector may be formed integrally with each other. The splitting may be done via crossover connections between inner conductors of adjacent coaxial lines.

In order to preserve the characteristic impedance, the lines connecting to the crossover element include impedance matching structures.

The antenna feeding network is usually connectable to a coaxial feeder cable using a coaxial connector. The coaxial connector may be placed at the bottom or end plate of the antenna, which bottom plate is typically perpendicular to the coaxial lines. The body of the coaxial connector is typically attached to the bottom plate made of a conductive material such as metal. There are two major requirements for such a connector: firstly, impedance must be maintained and secondly, passive intermodulation (PIM) must be minimized. In order to meet these requirements, a consistent electrical connection between the coaxial connector and the coaxial line is required. The coaxial line inner conductor is usually soldered to the central pin of the connector, but attaching the connector body correctly to the antenna bottom plate or antenna body may be more difficult. In case a soft coaxial line, e.g. a PTFE cable, is attached to the connector, soldering the cable outer conductor, or shield, often results in PIM since all braids in the outer conductor are not correctly soldered. Also, the junction from the connector body to the antenna body or reflector, often via a bottom plate attached to the antenna body or reflector, can result in PIM. In the case of an antenna using air filled coaxial lines where the outer conductors of the coaxial lines are part of the antenna body or reflector, it is even more important to obtain a correct electrical connection between the connector body and the antenna bottom plate. This may be difficult to achieve in an antenna feeding network as described above, since the attachment of the coaxial connector to the bottom plate is subject to substantial mechanical forces from to the thick coaxial feeder cables connected thereto.

One solution to this problem is disclosed in WO2006006913, which shows an antenna where the coaxial connector is connected to the outer and inner conductors of a coaxial line using a separate coaxial cable (see FIG. 2). The coaxial connector is held in place mechanically by being attached to the bottom plate, but the electrical connection is provided by means of the separate coaxial cable. This solution may improve the electrical connection, but may be disadvantageous in other aspects. Firstly, the arrangement involves a large number of parts which may occupy valuable space in the antenna and may also result in high cost. Secondly, the separate coaxial cable may introduce losses. Thirdly, the connection may still suffer from PIM due to currents flowing from the body of the coaxial connector to the bottom plate and the outer conductor(s)/reflector.

SUMMARY

An object of the present invention is to overcome at least some of the disadvantages of the prior art described above.

These and other objects are achieved by the present invention by means of an antenna feeding network according to a first aspect of the invention and an antenna arrangement according to a second aspect of the invention.

According to a first aspect of the invention, an antenna feeding network for a multi-radiator base station antenna is provided. The feeding network comprises substantially air filled coaxial lines and a coaxial connector for an antenna feeder cable, the connector being connected to at least one of the coaxial lines. The substantially air filled coaxial lines each have a central inner conductor and an elongated outer conductor surrounding the central inner conductor. The coaxial connector comprises a body having an attachment portion, the attachment portion being attached to, and arranged in abutment with, a portion of at least one outer conductor such that the body connects electrically and mechanically with the outer conductors of the coaxial lines.

In other words, the body or outer connection of the coaxial connector is provided with an attachment portion which is arranged in abutment or direct contact with a portion of at least one outer conductor, and is attached thereto to provide an effective electrical connection directly between the body or outer connection of the coaxial connector and the outer conductors of the coaxial lines. The portion of at least one outer conductor is preferably a longitudinally extending portion of the outer conductor, e.g. a bottom, top, or side wall portion of the outer conductor. Since the attachment portion is arranged in abutment or direct contact with the portion of at least one outer conductor and is attached thereto, the coaxial connector is effectively held in position relative the coaxial lines. Thus, there is no need for a mechanically rigid (and consequently costly) bottom plate at an end of the coaxial lines to support the coaxial connector mechanically. Thus, the bottom plate may be manufactured economically, for example in a plastic material. The attachment portion is typically integrally formed with the body of the coaxial connector, but it is foreseeable within the scope of the invention that the attachment portion is a separate component which is attached to the body, i.e. not integrally formed with the body of the coaxial connector.

The invention is based on the insight that a further improved electrical connection between the coaxial connector and the coaxial lines may be achieved in a cost effective and compact manner by providing the coaxial connector with a body having an attachment portion which is attached directly to a wall portion of at least one outer conductor of the coaxial lines.

It is understood that coaxial line refers to an arrangement comprising an inner conductor and an outer conductor with insulating or dielectric material or gas in between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor. The coaxial lines may each be provided with air between the inner and outer conductors. The air between the inner and outer conductors thus replaces the dielectric material often found in coaxial cables. It is further understood that the term substantially air filled is used to describe that the coaxial line is not necessarily provided only with air in between the outer and inner conductors, but may also be provided for example with support elements arranged to hold the inner conductors in position. The coaxial line may thus be described as substantially, but not completely, air filled.

It is understood that any directions referred to in this application relate to an antenna feeding network and multi-radiator base station antenna where a plurality of coaxial lines are arranged side by side in parallel to each other and also in parallel with a reflector on which the radiating elements are arranged. Longitudinally in this context refers to the lengthwise direction of the coaxial lines, and sideways refers to a direction perpendicular to the lengthwise direction of the coaxial lines. It is also understood that the term encircle used herein refers in general to completely surrounding an object, and is not limited to a circular surrounding shape.

In embodiments, the attachment portion is attached to the longitudinally extending portion using attachment means, such as screws or bolts, extending perpendicularly relative said longitudinally extending portion. The attachment portion may be attached using at least two, preferably four, attachment means arranged in a longitudinally and laterally spaced apart manner.

In embodiments, the coaxial connector comprises a central pin connected to at least one of the central inner conductors of the coaxial lines. An end portion of said central pin and an end portion of a first of said at least one central inner conductor may each be provided with an engaging portion configured to engage with each other, wherein each engaging portion is in the form of a cavity or a rod-shaped protrusion.

In embodiments, the central pin is galvanically connected to the one central inner conductor, and the first central inner conductor is indirectly interconnected with at least one further central inner conductor of the central inner conductors to provide a capacitive and/or inductive connection there between. The indirect interconnection may be achieved by means of at least one connector device configured to indirectly interconnect the first central inner conductor and the at least one further central inner conductor. In other embodiments, the first central inner conductor is galvanically interconnected with the least one further central inner conductor.

Herein the word indirectly means that conductive material of the connector device is not in direct physical contact with the conductive material of the first inner conductor and the second inner conductor, respectively. Indirectly thus means an inductive, a capacitive coupling or a combination of the two.

In embodiments, there may be at least one insulating layer arranged in between the conductive material of the connector device and the conductive material of the inner conductors. This at least one insulating layer may be arranged on the connector device and thus belong to the connector device and/or it may be arranged on the first inner conductor or on the at least one further central inner conductor or on both inner conductors. The at least one insulating layer may alternatively comprise a thin film which is arranged between the conductive material of the connector device and the conductive material of the inner conductor(s). The at least one insulating layer may also be described as an insulating coating. The insulating layer or insulating coating may be made of an electrically insulating material such as a polymer material or a non-conductive oxide material with a thickness of less than 50 μm, such as from 1 μm to 20 μm, such as from 5 μm to 15 μm, such as from 8 μm to 12 μm. Such a polymer or oxide layer may be applied with known processes and high accuracy on the connector device and/or on the inner conductor(s).

In embodiments, the connector device may be configured to be removably connected to the inner conductors. This allows a quick reconfiguration of the antenna feeding network, if necessary or can be used for trouble-shooting in antenna production.

In embodiments, the connector device may be realized as a snap on element comprising at least one pair of snap on fingers and a bridge portion, whereby the snap on fingers may be connected to the bridge portion and wherein the snap on fingers are configured to be snapped onto the inner conductors. The snap on element may comprise two pairs of snap on fingers which are connected by the bridge portion, wherein the two pairs of snap on fingers may be configured to be snapped onto a respective inner conductor. These embodiments are advantageous since they allow convenient assembly of the antenna feeding network, where the connector device is simply snapped onto the inner conductors. The connector device may also be arranged with two or more bridge portions, connecting three or more pairs of snap on fingers.

In embodiments, the first inner conductor comprises a connector section having at least one engaging portion. Each of the at least one further inner conductors comprises corresponding engaging portion(s), each adapted to engage with a corresponding engaging portion of the connector section. Each engaging portion is in the form of a cavity or rod-shaped protrusion. An insulating layer is provided in said cavity and/or on said rod-shaped protrusion, or alternatively, an insulating layer is provided as an insulating film between the cavity and the rod-shaped protrusion. Thus, an indirect connection may be provided between the inner conductors. The cavity or cavities may have a depth corresponding to a quarter wavelength at the centre of the used frequency band. The connector section may be arranged such as to connect the first inner conductor to one, two, three, four or more inner conductors.

In further embodiments, a DC grounding stub or a coil is connected between the central pin and the body, or between the central pin and the outer conductor to which the connector body is attached, in order to divert undesired electromagnetic energy induced on said central inner conductor to ground. A DC grounding stub is defined as a length of transmission line which is DC-connected in one end, and which impedance is arranged in such a way that it will, at its other end, present a high impedance in the RF frequency band it is designed to be used in. It can typically have a length corresponding to a quarter wave length at frequency corresponding the center of the frequency band it is designed to be used in. Alternatively, the DC grounding stub or coil may be connected between a central inner conductor of a coaxial line (to which the central pin is connected) and the corresponding outer conductor. In such embodiments, the quarter wave corresponds to the electrical distance between the connection to the outer conductor and the place where further inner conductor(s) are connected to the central pin or to the central inner conductor.

In further embodiments, an RF grounded stub or coil is indirectly connected between the central pin and the body, or between the central pin and the outer conductor to which the connector body is attached, in order to divert undesired electromagnetic energy induced on said central inner conductor to ground. Alternatively, the RF grounding stub or coil may be indirectly connected between a central inner conductor of a coaxial line (to which the central pin is connected) and the corresponding outer conductor. In such embodiments, the connector maybe used not only for the RF signal, but also to provide DC voltage and communication for ancillary devices such as a RET (Remote Electrical Tilt) motor. In such a case the communication may be modulated on a carrier as defined in e.g. 3GPP specification TS 25.461.

In embodiments comprising an RF grounded stub or coil, the antenna feeding network advantageously comprises, or is connected to, an electric circuit for separating the DC power and the communication signal, and for demodulating the communication signal to generate a suitable low frequency serial bus signal. A device providing such functionality is commonly called a smart bias-T. RF grounding can be achieved by replacing the DC connection by a capacitor with a value high enough to act as a short circuit at the RF frequency at which the antenna is designed to operate, e.g. 1710 to 1970 MHz for a 3G system. After the RF grounding, the combined DC power and communication signal can be fed through an ordinary electrical wire to a circuit board located somewhere else in the antenna. In order to protect the capacitor and the circuitry forming the smart bias-T, it may be necessary to provide a Gas Discharge Tube connected between the both sides of the capacitor.

The embodiments described above may be combined in any practically realizable way.

According to a second aspect of the invention, an antenna arrangement is provided. The antenna arrangement comprises an antenna feeding network according to the first aspect of the invention (or embodiments thereof), a reflector extending in parallel with the coaxial lines and radiators attached to said reflector. The attachment portion is attached to, and is arranged in abutment with, a portion of at least one outer conductor. The reflector may be integrally formed with the outer conductors of the coaxial lines.

The above description with reference to the first aspect of the invention also applies to describe the second aspect of the invention and embodiments thereof.

BRIEF DESCRIPTION OF THE DRAWINGS

These and other aspects of the present invention will now be described in more detail with reference to the appended drawings, which show presently preferred embodiments of the invention, wherein.

DETAILED DESCRIPTION

Figure 1:
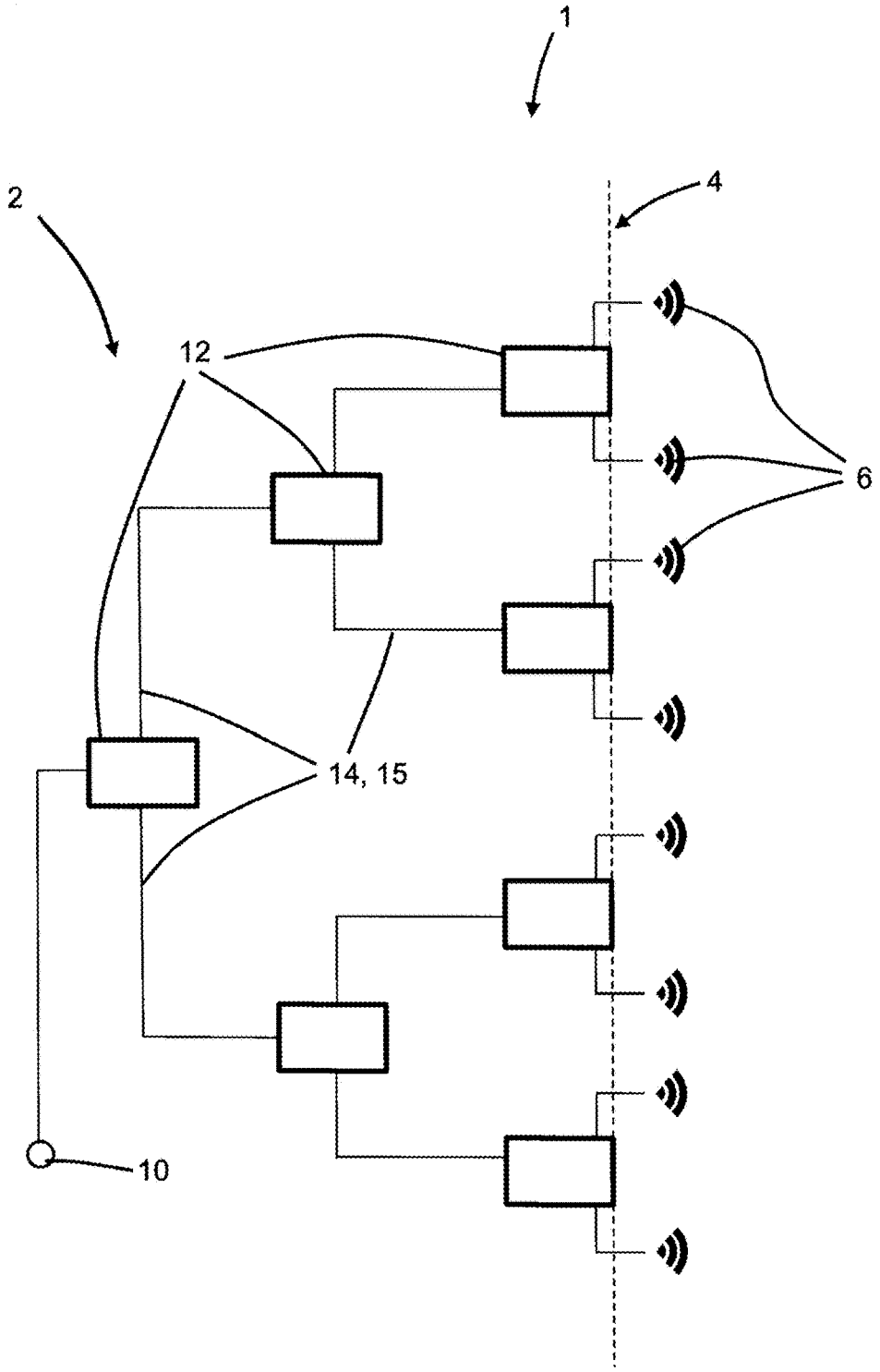
FIG. 1 schematically illustrates a multi-radiator antenna arrangement.

FIG. 1 schematically illustrates an antenna arrangement 1 comprising an antenna feeding network 2, an electrically conductive reflector 4, which is shown schematically in FIG. 1, and a plurality of radiating elements 6. The radiating elements 6 may be dipoles.

The antenna feeding network 2 connects a coaxial connector 10 to the plurality of radiating elements 6 via a plurality of lines 14, 15, which may be coaxial lines, which are schematically illustrated in FIG. 1. The signal to/from the connector 10 is split/combined using, in this example, three stages of splitters/combiners 12.

Figure 2:
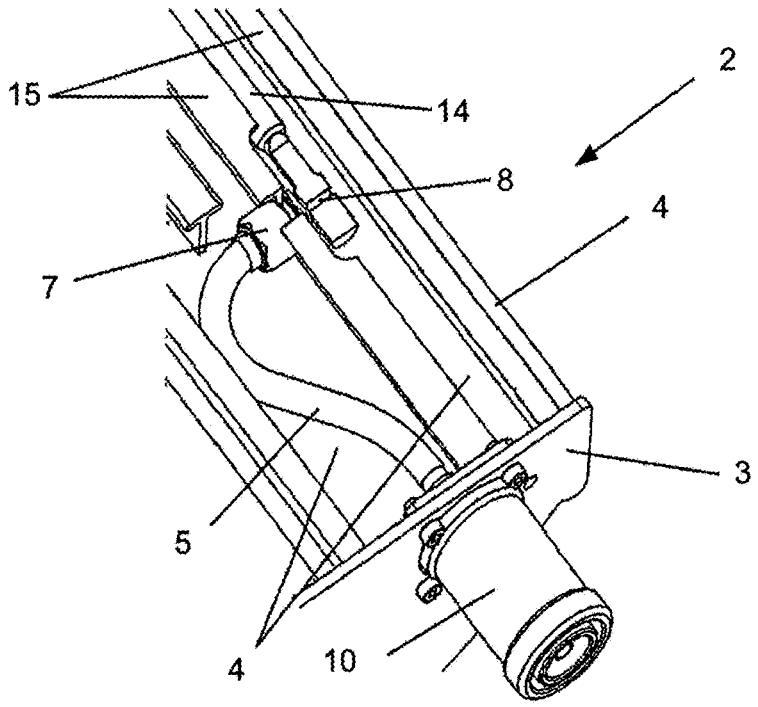
FIG. 2 shows a prior art antenna feeding network where the coaxial connector is attached to a bottom plate.

FIG. 2 shows a prior art antenna feeding network 2 comprising an electrically conductive reflector 4 and a substantially air filled coaxial line formed by an outer conductor 15 and an inner conductor 14. The outer conductor 15 are integrally formed with the reflector 4. A coaxial connector 10 is mechanically attached to a bottom plate 3, which in turn is attached to end portions of the reflector/outer conductors. The coaxial connector 10 is electrically connected to the inner and outer conductors via a separate coaxial cable 5. At an end of the separate coaxial cable, its outer line is connected to the outer conductor 15 using a connection piece 7, and its inner line is connected to the inner conductor 14 in a groove 8.

Figure 3:
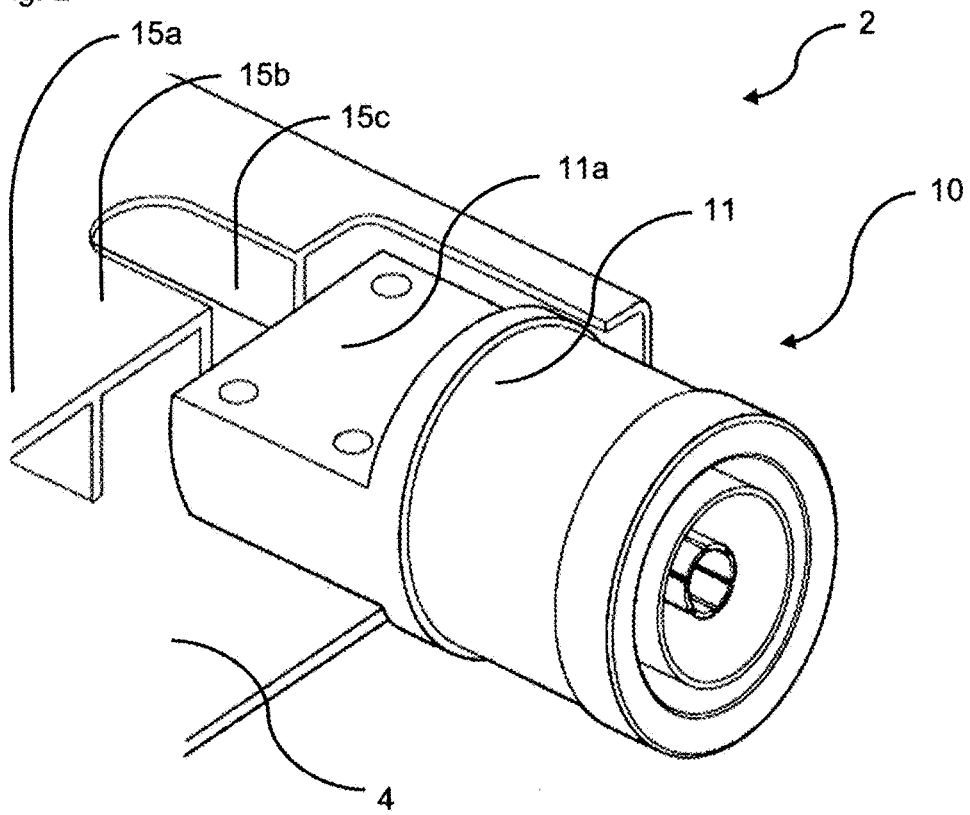
FIG. 3 shows a view from the rear side of parts of an antenna feeding network according to an embodiment of the first aspect of the invention.

FIG. 3 shows a view from the rear side of parts of an antenna feeding network according to an embodiment of the first aspect of the invention. The rear side in this context refers to the side of the antenna feeding network opposite to the (reflector) front side on which radiating elements (not shown) are mounted. The antenna feeding network comprises outer conductors 15*a-c* which together with inner conductors arranged therein (not shown) form air filled coaxial lines. The outer conductors 15*a-c* have square cross sections and are formed integrally and in parallel to form a self-supporting structure. The outer conductors 15*a-c* are formed integrally with the reflector 4 in the sense that the upper and lower walls of the outer conductors are formed by the front side and the back side of the reflector, respectively. A coaxial connector 10 is shown which comprises a body or outer connector 11 which is provided with an attachment portion 11*a*. The attachment portion 11*a* is arranged to extend in parallel and in abutment with a longitudinally extending portion of the outer conductors/reflector, i.e. the portion of the reflector or outer conductors which is, as seen in the figure, arranged directly below the attachment portion. The attachment portion 11*a* is attached to the longitudinally extending portion of the reflector 4 by means of for example screws or bolts (not shown) in the holes illustrated in the figure. Electrical connection between the body of the coaxial connector and the reflector/outer conductors is achieved through direct contact between the attachment portion and the reflector. A mechanically stable attachment of the coaxial connector may be achieved due to the large area of contact between the attachment portion and the reflector.

Figure 4:
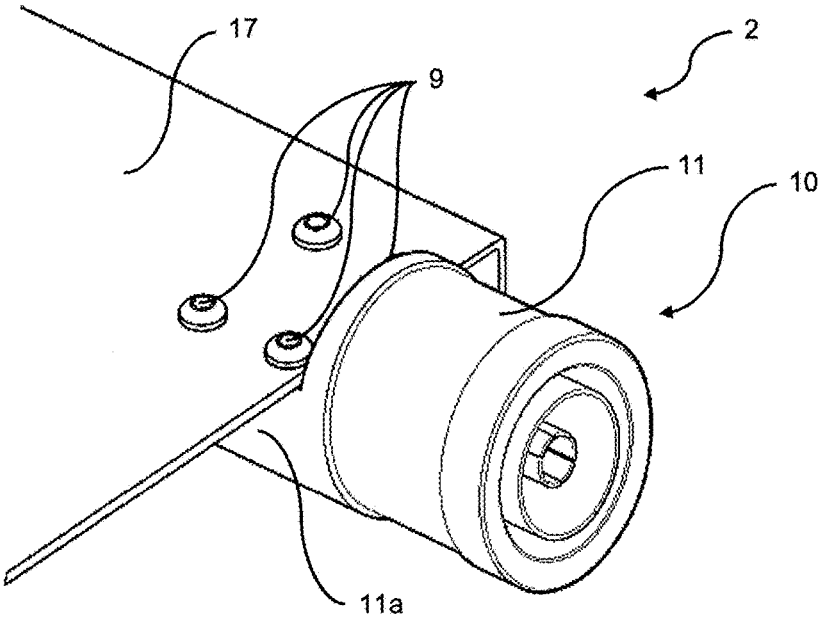
FIG. 4 shows a view from the reflector side of an antenna feeding network according to an embodiment of the first aspect of the invention.

FIG. 4 shows a view from the front side 17 of the reflector of an antenna feeding network according to an embodiment of the first aspect of the invention. The front side in this context refers to the side of the antenna feeding network on which the front of the reflector and the radiating elements (not shown) are disposed. The reflector is integrally formed with the outer conductors in the same manner as described above with reference to FIG. 3, but may in other embodiments be a separate component. A coaxial connector 10 is shown which comprises a body or outer connector 11 which is provided with an attachment portion 11*a*. The attachment portion 11*a* extends in parallel with, and in abutment with, a longitudinally extending portion of the outer conductors. The attachment portion 11*a* is attached to the longitudinally extending portion by means of screws 9 extending in perpendicular relative the front side 17 of reflector. Since the screws are spaced apart both in the longitudinal and in the lateral direction, it is ensured that a consistent electrical connection is achieved between the attachment portion and the outer conductors, even if the coaxial connector is subject to mechanical forces in different directions.

Figure 5:
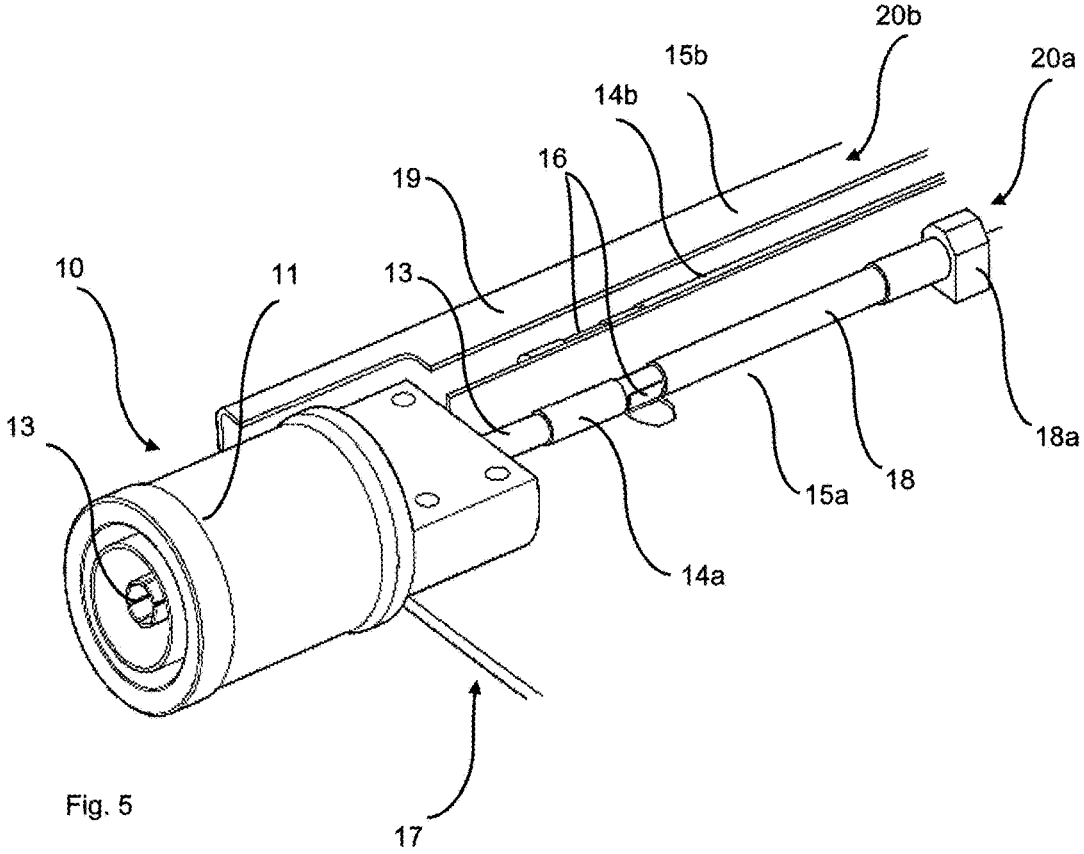
FIG. 5 shows a view from the rear side of the embodiment in FIG. 4.

FIG. 5 shows a view from the rear side of the same embodiment shown in FIG. 4. In this figure, part of the rear side of the reflector is removed to illustrate the internal components of the antenna feeding network. A central pin 13 of the coaxial connector 10 extends through the body 11 and connects with a first central inner conductor 14*a* arranged inside an outer conductor to form a first coaxial line. The interconnection between the central pin and the first central inner conductor is shown in more detail in FIG. 6. The first central inner conductor 14*a* is interconnected to a second central inner conductor 14*b* using a connector device 16 extending between the two coaxial lines. The first central inner conductor 14*a* is connected to the reflector (and consequently also to the outer conductors 15*a*, 15*b*) using a quarter wave stub 18 which is grounded to the reflector by grounding device 18*a*. The quarter wave stub 18 is configured to provide a DC ground for the inner conductor 14*a*.

In the embodiment in FIG. 5, the quarter wave stub 18 and the first central inner conductor 14*a* are both formed by a rod shaped conductor, where the portion of the conductor between the central pin 13 and the connector device forms the first central inner conductor 14*a*, while the portion of the conductor between the connector device 16 and the grounding device 18*a* forms the quarter wave stub 18. The grounding device 18*a* may also be considered a part of the quarter wave stub. In embodiments, the connector device 16 may be configured to provide an indirect interconnection between the first central inner conductor 14*a* and the second central inner conductor 14*b*. The indirect interconnection may be achieved using at least one insulating layer (not shown) arranged in between the conductive material of the connector device and the conductive material of the inner conductors.

Although the first and second inner conductors 14*a*, 14*b* are illustrated as neighbouring inner conductors they may actually be further apart thus having one or more coaxial lines, or empty cavities or compartments, in between.

Although the invention is illustrated with two neighbouring inner conductors 14*a*, 14*b* it falls within the scope to have a connector device 16 than can bridge two or even more inner conductors. Such a connector device (not shown) may thus be designed so that it extends over a plurality of coaxial lines between two inner conductors or over empty cavities or compartments. Such a connector device (not shown) may also be used to connect three or more inner conductors.

Figure 6:
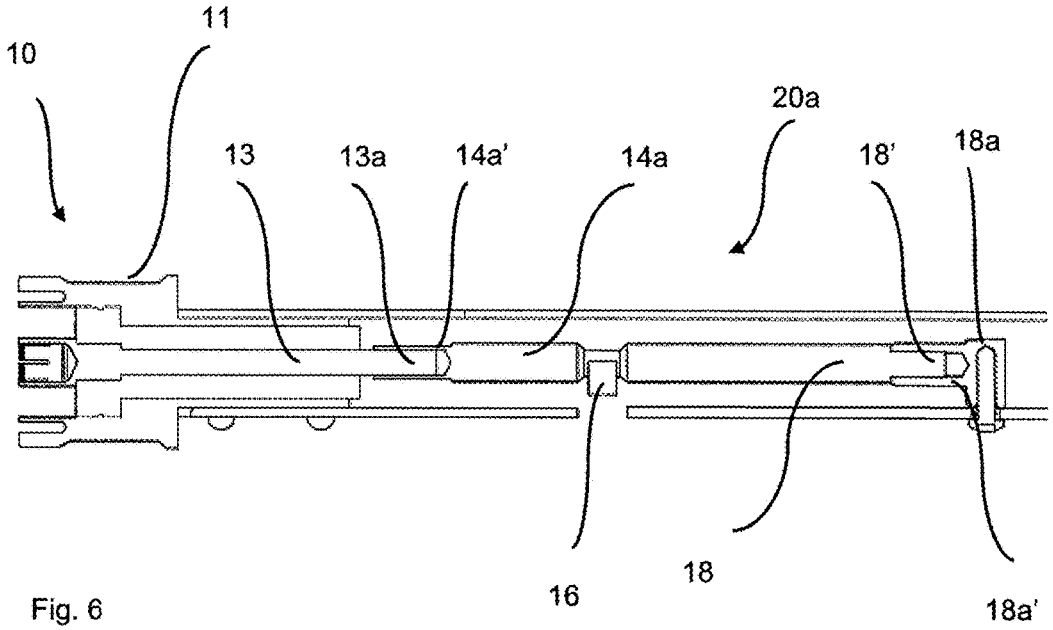
FIG. 6 shows a cross section side view of the embodiment in FIGS. 4 and 5 where DC-grounding of the inner conductor is illustrated.

FIG. 6 shows a cross section side view of the embodiment shown in FIGS. 4 and 5. The cross section is seen through the center pin of the coaxial connector 10, the first central inner conductor 14*a* and the quarter wave stub 18. The central pin 13 is provided with an engaging portion in the form of a rod-shaped protrusion 13*a* extending axially from its end, and which is arranged inside a corresponding engaging portion in the form of an axially extending cavity 14*a*' in a first end of the first central inner conductor 14*a*. Thereby, an electrical connection between the central pin 13 and the inner conductor 14*a* is achieved. The rod-shaped protrusion 13*a* is attached in the cavity 14*a*' by means of for example soldering or electrically conductive glue to provide a galvanic connection there between. The end of the quarter wave stub 18 (being opposite the connector device 16) is provided with an engaging portion in the form of a rod-shaped protrusion 18' extending axially, and which is arranged inside a corresponding engaging portion in the form of a cavity 18*a*' in the grounding device 18*a*. The rod-shaped protrusion 18' is attached in the cavity 18*a*' by means of for example soldering or electrically conductive glue to provide a galvanic connection there between. The grounding device is attached to the outer conductor using a screw inserted from the front side of the reflector (from beneath as seen in the figure). In the figure, it is also illustrated that the connector device 16 may be inserted from the front side through an opening in the outer conductor/reflector. The quarter wave stub 18 and the grounding device 18*a* provides a DC ground for the central pin 13 (since the central pin and the first inner conductor 14*a* are galvanically interconnected). As described above however, the first central inner conductor may be indirectly interconnected with at least the second central inner conductor. Thus, at least parts of the antenna feeding network may be indirectly coupled.

Figure 7:
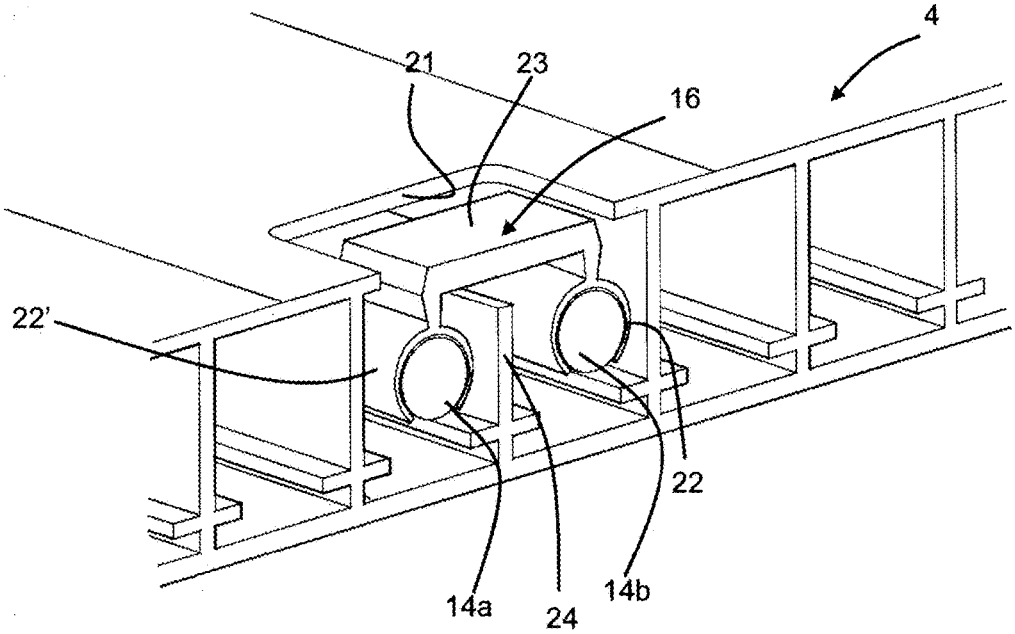
FIG. 7 shows a cross section view of an antenna feeding network according to an embodiment of the first aspect of the invention.

In FIG. 7, a cross section view of an antenna feeding network according to an embodiment of the first aspect of the invention is shown. This embodiment is similar to the embodiment shown in FIGS. 4-6, but the coaxial connector is not visible in the shown cross section, which is cut at right angle through the antenna feeding network close to the connector device 16. The connector device is arranged in an opening 21 in the reflector 4. The connector device 16 is clipped or snapped onto the first inner conductor 14*a* and the second inner conductor 14*b*. The connection between the first inner conductor 14*a* and the second inner conductor 14*b* is electrically indirect, which means that it is either capacitive, inductive or a combination thereof. This is achieved by providing a thin insulating layer of a polymer material or some other insulating material (e.g. a non-conducting oxide) on the connector device 16. The insulating layer may have a thickness of 1 μm to 20 μm, such as from 5 μm to 15 μm, such as from 8 μm to 12 μm, or may have a thickness of 1 μm to 5 μm. The insulating layer may cover the entire outer surface of the connector device 16, or at least the portions 22, 22' of the connector device 16 that engage the first and second inner conductors 14*a*, 14*b*. The insulating layer may alternatively be applied to the inner conductors 14*a*, 14*b* on at least to the portions of the inner conductors being close to fingers 22, 22', or on both the connector device and the inner conductors.

The connector device 16 comprises a bridge portion 23 and two pairs of snap on fingers 22, 22'. One of the two pairs of snap on fingers 22' is arranged close to one end of the bridge portion 23 and the other of the two pairs of snap on fingers 22 is arranged close to the other end of the bridge portion 23. The two pairs of snap on fingers 22, 22' may be connected to the bridge portion 23 via connecting portions configured such that the bridge portion 23 is distanced from the first and second inner conductors 14*a*, 14*b*. In other embodiments, the snap on fingers 22, 22' are connected directly to the bridge portion 23. The connecting portions, as well as the other portions of the connector device, are shaped to optimize the impedance matching of the splitter/combiner formed by the connector device and the coaxial lines. The shape, or preferably the diameter of the connecting inner conductors may also contribute to the matching of the splitter/combiner.

As can be seen from FIG. 7, the vertical separating wall portion 24 is cut down to about two-thirds to three-quarters of its original height in the area of the opening 21 so that the connector device 16 does not protrude over the front side of the electrically conductive reflector 4. In other embodiments, the wall portion 24 is cut down all the way to the floor of the outer conductors. The remaining height of the wall portion is adapted together with the other components, such as the connector device to optimize the impedance match.

In other embodiments (not shown in the figures), only one pair of snap on fingers is provided, for example the pair of snap on fingers 22' engaging the first inner conductor 14*a* providing an indirect connection, and to let the other end of the bridge portion 23 contact the second inner conductor 14*b* directly without insulating layer or coating. This direct connection can be provided by connecting the bridge portion 23 to inner conductor 14*b* by means of a screw connection, or by means of soldering, or by making the bridge portion an integral part of inner conductor 14*b*, or by some other means providing a direct connection.

Figure 8:
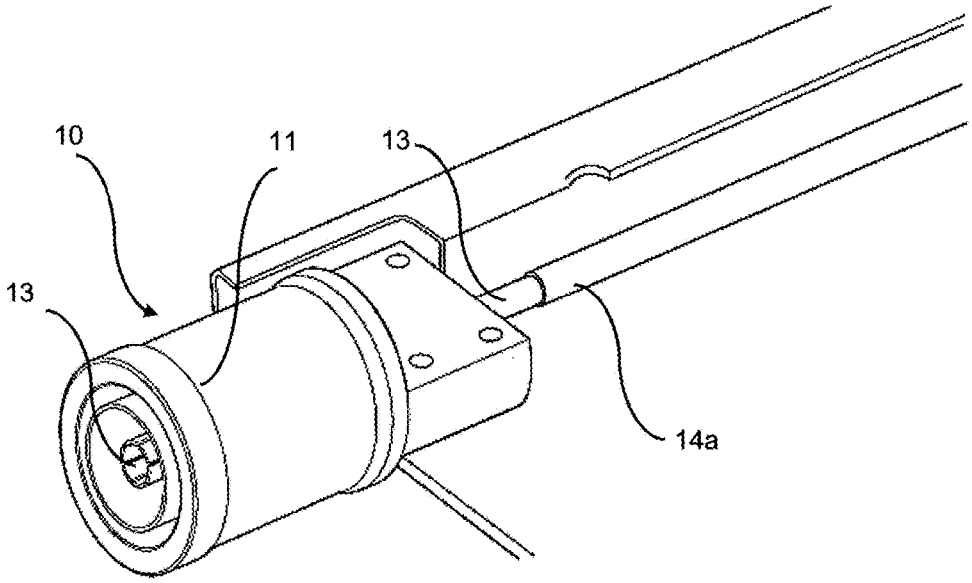
FIG. 8 shows a view from the rear side of a feeding network according to an alternative embodiment of the first aspect of the invention.

FIG. 8 shows a view from the rear side of an alternative embodiment where the coaxial connector 10 is directly connected to a first coaxial line. The central pin 13 and the first central inner conductor 14*a* are each provided with an engaging portion in the same way as described above with reference to the embodiment in FIGS. 5 and 6. The central pin 13 is galvanically connected to the first central inner conductor 14*a* and to the antenna feeding network. In this embodiment, DC-grounding is typically made in another position within the antenna feeding network.

Figure 9:
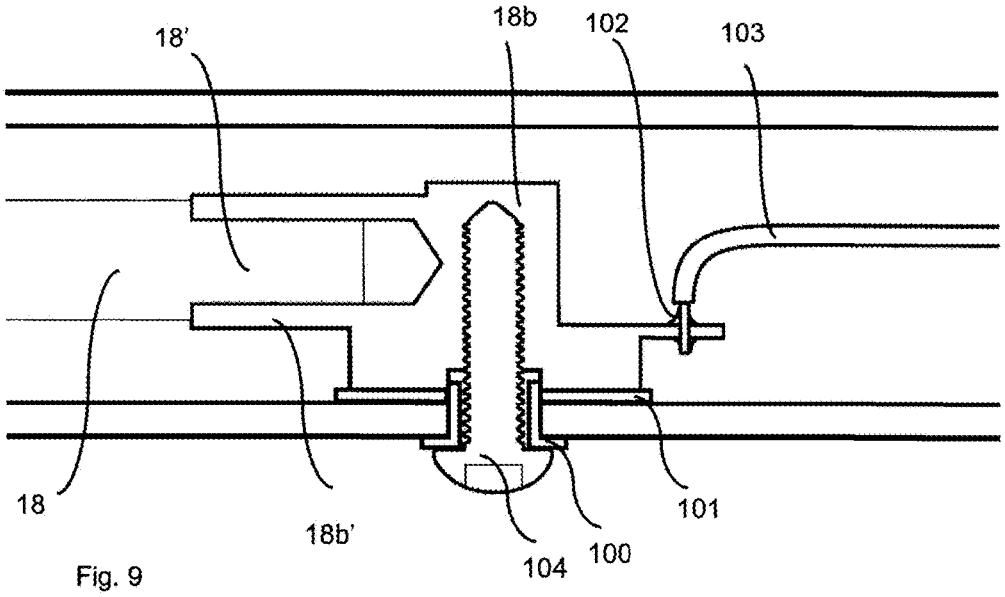
FIG. 9 shows a cross section view of parts of an antenna feeding network according to an embodiment of the first aspect of the invention where the DC grounding has been replaced with a RF grounding.

FIG. 9 shows a cross section side view of parts of an embodiment similar to that shown in FIGS. 4, 5 and 6, with the difference that the center pin is RF grounded instead of DC grounded. In the figure, only the end of the quarter wave stub 18, the grounding device 18*b* and the outer conductor is shown. The connection to the coaxial connector and to another inner conductor can be made in the same way as in FIGS. 5-6. The end of the quarter wave stub 18 (being opposite the connector device 16 as shown in FIGS. 5-6) is provided with an engaging portion in the form of a rod-shaped protrusion 18' extending axially, and which is arranged inside a corresponding engaging portion in the form of a cavity 18*b'* in the grounding device 18*b*. The rod-shaped protrusion 18' is attached in the cavity 18*b'* by means of for example soldering or electrically conductive glue to provide a galvanic connection there between. The grounding device is mechanically attached to the outer conductor using a screw 104 inserted from the front side of the reflector (from beneath as seen in the figure). The grounding device is electrically isolated from the outer conductor by means of an isolating film 101 or layer and an isolating bushing 100. The screw 104 is arranged through the bushing 100 which thereby isolates the screw from the outer conductor. The isolating film is arranged between the grounding device 18*b* and the inside surface of the outer conductor. The isolating film can be made in a polymer material such as Kapton, or it can be in the form of an oxide on one or both interfacing metal surfaces. In other embodiments, the isolating film can consist of a polymer layer deposited on one or both interfacing metal surfaces, i.e. on the grounding device 18*b* and/or on the inside surface of the outer conductor. The film or layer is kept thin and will together with the grounding device and the outer conductor act as a capacitor. An electrical wire 103 is soldered to the grounding device 102 and is arranged to connect the DC voltage and communication signal to the circuitry (not shown) arranged to separate the DC voltage from the communication signal, and demodulate the communication signal. The quarter wave stub 18 and the grounding device 18*b* together with the isolating layer 101 provide an RF ground for the central pin (ref. 13 in FIGS. 4-6). As described above, the first central inner conductor may advantageously be indirectly interconnected with at least the second central inner conductor. Thus, at least parts of the antenna feeding network may be indirectly coupled.

The description above and the appended drawings are to be considered as non-limiting examples of the invention. The person skilled in the art realizes that several changes and modifications may be made within the scope of the invention. For example, the number of coaxial lines may be varied and the number of radiators/dipoles may be varied. Furthermore, the shape and placement of the coaxial connector may be varied. Furthermore, the reflector does not necessarily need to be formed integrally with the coaxial lines, but may on the contrary be a separate element. The scope of protection is determined by the appended patent claims.

The invention claimed is:

1. An antenna feeding network for a multi-radiator base station antenna, said feeding network comprising:

substantially air filled coaxial lines, each having a central inner conductor and an elongated outer conductor surrounding the central inner conductor;

a coaxial connector for an antenna feeder cable, said connector being connected to at least one of said coaxial lines;

wherein said coaxial connector comprises a body having an attachment portion arranged to extend in parallel and in abutment with a longitudinally extending portion of at least one outer conductor, said attachment portion being attached to said longitudinally extending portion, whereby said body connects electrically with said outer conductors.

2. The antenna feeding network according to claim 1, wherein said attachment portion is attached to said longitudinally extending portion by means of screws or bolts extending perpendicularly relative said longitudinally extending portion.

3. The antenna feeding network according to claim 1, wherein said coaxial connector comprises a central pin connected to at least one of the central inner conductors of said coaxial lines.

4. The antenna feeding network according to claim 3, wherein an end portion of said central pin and an end portion of a first of said at least one central inner conductor are each provided with an engaging portion configured to engage with each other, wherein one of said engaging portions is in the form of a cavity and the other is in the form of a protrusion.

5. The antenna feeding network according to claim 3, wherein said central pin is galvanically connected to said first central inner conductor, and wherein said first central inner conductor is indirectly interconnected with at least one further central inner conductor of said central inner conductors to provide a capacitive and/or inductive connection there between.

6. The antenna feeding network according to claim 5, further comprising at least one connector device configured to indirectly interconnect said first central inner conductor and said at least one further central inner conductor.

7. The antenna feeding network according to claim 6, comprising at least one insulating layer, wherein the insulating layer is arranged on the connector device and/or on said first central inner conductor and/or on the at least one further central inner conductor.

8. The antenna feeding network according to claim 3, further comprising a DC grounded stub or a coil connected between said central pin and said body.

9. The antenna feeding network according to claim 5, further comprising a DC grounded stub or a coil connected between said first central inner conductor and an outer conductor surrounding said first central inner conductor.

10. The antenna feeding network according to claim 8, wherein said DC grounded stub is grounded to the reflector by a grounding device, wherein an end portion of said stub and an end portion of said grounding device are each provided with an engaging portion configured to engage with each other, wherein one of said engaging portions is in the form of a cavity and the other is in the form of a protrusion.

11. The antenna feeding network according to claim 1, wherein said longitudinally extending portion is formed by at least one bottom or top portion of said outer conductors.

12. The antenna feeding network according to claim 1, wherein said longitudinally extending portion is formed by at least one side wall portion of said outer conductors.

13. The antenna feeding network according to claim 3, further comprising a RF grounded stub or coil indirectly connected between said central pin and said body.

14. The antenna feeding network according to claim 5, further comprising a RF grounded stub or coil indirectly connected between said first central inner conductor and an outer conductor surrounding said first central inner conductor.

15. The antenna feeding network according to claim 13, wherein said RF grounded stub is indirectly connected to at least one of said outer conductors by a grounding device, wherein an end portion of said stub and an end portion of said grounding device are each provided with an engaging portion configured to engage with each other, wherein one of said engaging portions is in the form of a cavity and the other is in the form of a protrusion.

16. The antenna feeding network according to claim 15, further comprising a circuitry connected to the grounding device 18*b*, said circuitry being arranged to separate DC voltage and a communication signal.

17. The antenna feeding network according to claim 15, wherein a gas discharge tube is connected between the grounding device and the outer conductor.

18. An antenna arrangement comprising:

an antenna feeding network having:

substantially air filled coaxial lines, each having a central inner conductor and an elongated outer conductor surrounding the central inner conductor;

a coaxial connector for an antenna feeder cable, said connector being connected to at least one of said coaxial lines;

wherein said coaxial connector comprises a body having an attachment portion arranged to extend in parallel and in abutment with a longitudinally extending portion of at least one outer conductor, said attachment portion being attached to said longitudinally extending portion, whereby said body connects electrically with said outer conductors; and a reflector extending in parallel with said coaxial lines, wherein said attachment portion is attached to, and is arranged in abutment with, a longitudinal portion of at least one outer conductor.

19. The antenna arrangement according to claim 18, wherein said reflector is integrally formed with the coaxial lines.

* * * * *